US005932318A

United States Patent [19]

Uchiyama

[11] Patent Number: 5,932,318

[45] Date of Patent: Aug. 3, 1999

[54] COLOR IMAGE FORMING SHEET

[75] Inventor: Koichi Uchiyama, Ibaraki-ken, Japan

[73] Assignee: Riso Kagaku Corporation, Tokyo, Japan

[21] Appl. No.: 08/739,675

[22] Filed: Nov. 21, 1996

[30] Foreign Application Priority Data

Nov. 29, 1995 [JP] Japan ..... 7-310872

[51] Int. Cl.[6] ..... B41M 5/00

[52] U.S. Cl. ..... 428/195; 283/117; 428/211

[58] Field of Search ..... 428/195, 204, 428/411.1, 913, 207, 211; 427/195; 283/117

[56] References Cited

U.S. PATENT DOCUMENTS

| | | |
|---|---|---|
| 2,270,746 | 1/1942 | Wyckoff . |
| 3,329,590 | 7/1967 | Renfrew . |
| 3,429,702 | 2/1969 | Lorber . |
| 4,458,175 | 7/1984 | Weekley . |

FOREIGN PATENT DOCUMENTS

| | | |
|---|---|---|
| 0 743 190 | 11/1996 | European Pat. Off. . |
| 389297 | 9/1908 | France . |
| 665 029 | 9/1929 | France . |
| 652 579 | 10/1937 | Germany . |
| 43 39 216 | 4/1994 | Germany . |

OTHER PUBLICATIONS

IBM Technical Disclosure Bulletin, vo. 25, No. 5, Oct. 1992, New York, p. 2598 XP002012646, R. L. Garwin: Additive Color Printing.

Patent Abstracts of Japan, vo. 010, No. 060, (P–435), Mar. 11, 1986 & JP 60 202446 A (Ricoh KK), Oct. 12, 1985.

*Primary Examiner*—Bruce H. Hess

*Attorney, Agent, or Firm*—Kanesaka & Takeuchi

[57] ABSTRACT

A color image forming sheet is formed of a sheet substrate and a color area having plural colors. The plural colors are arranged in a regular pattern on the surface of the substrate so that a ground color of the substrate surface is exposed in a regular pattern, in which a desired color is presented by a color mixture when part of the sheet surface is covered.

8 Claims, 12 Drawing Sheets

1
2
3
4
5
6
7
C
M
Y
9.8

81

81
81
80
82

1

C
M
Y
C M Y
9.8
7
6

COLOR IMAGE FORMING SHEET

BACKGROUND OF THE INVENTION

The present invention relates to a color image forming sheet capable of affording a color image by the use of a simple means.

In the printing field, there are many methods to obtain an image of various color tones. One of them is to make some different printing plates corresponding to one original image and to form an image on a sheet by printing with the plates. In the case of color printing by the method, an original image is separated into three images of the three primary colors; three plates are prepared according to the three images; different primary-colored inks are applied on each of the three plates; and, each of the three plates is applied onto the same sheet, thereby to form an image of various color tones on the sheet.

According to the conventional method, it is necessary that a plate making or printing operation be performed a plural number of times in order to obtain a single color image. This is troublesome. In the case of manual printing, it takes time and labor three times as much as that required in the case of forming a monochromatic image, and if a printing apparatus is used, the apparatus is required to be three times larger in scale.

It is an object of the present invention to provide a simple color image forming apparatus capable of affording a color image by a single operation which is comparable to that in monochromatic printing.

SUMMARY OF THE INVENTION

A color image forming sheet in a first aspect comprises a sheet substrate and a color area having plural colors, the plural colors being arranged in a regular pattern on the surface of the substrate so that a ground color of the substrate surface is exposed in a regular pattern, in which a desired color is presented by a color mixture when part of the surface of the sheet is covered.

A color image forming sheet in a second aspect comprises a sheet substrate, a color area having plural colors arranged in a regular pattern on part of the surface of the substrate, and a ground color area with a ground color of the surface of said substrate being exposed in a regular pattern without being covered with the color area, in which a desired color is presented by a color mixture when part of the surface of the sheet is covered.

A color image forming sheet in a third aspect, in combination with the color image forming sheet described in the second aspect, is characterized in that the color area comprises color stripes of plural colors arranged in a predetermined order and in parallel with each other, and the ground color area comprises ground color stripes each of which appears between and parallel with adjacent color stripes in the color area.

A color image forming sheet a fourth aspect, in combination with the color image forming sheet described in the second aspect, is characterized in that the color area comprises color stripes of plural colors arranged in a predetermined order and in parallel with each other, and said ground color area comprises ground color stripes arranged along a direction perpendicular to the color stripes in said color area, said ground color stripes appearing at predetermined intervals in a direction of the color stripes in said color area to divide each of the color stripes in the color area into plural portions.

In the color image forming sheet, a predetermined color is observed by a color mixture of colors present in the color area and the ground color area. If the color area and the ground color area are covered with a pattern corresponding to the regular pattern of the color area and that of the ground color area, a desired color image can be presented on the color image forming sheet by a color mixture of uncovered colors and ground color.

DETAILED DESCRIPTION OF THE PREFERRED EMBODIMENTS

Figure 1A:
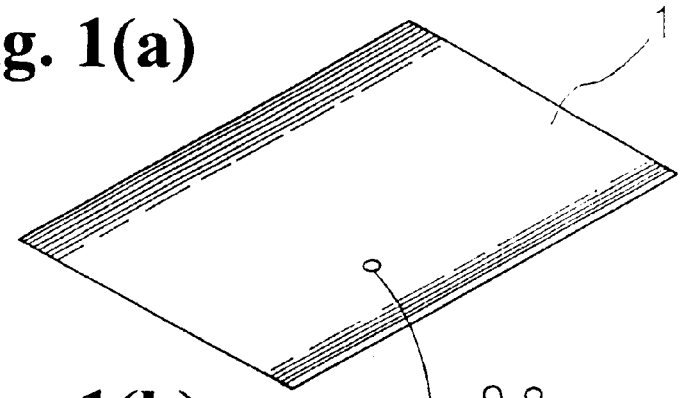
FIG. 1 shows a perspective view of a color image forming sheet according to an embodiment of the present invention and a partially enlarged view thereof.
Figure 1B:
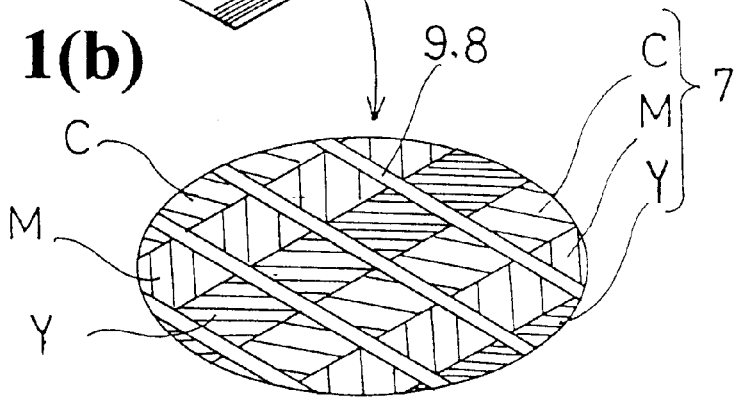

The embodiments of the present invention which will be described hereinafter are concerned with a color image object of arbitrary colors obtained by a simple operation, a method for forming the color image object, an apparatus for forming the color image object, and a color image forming sheet and a cover sheet both constituting the color image object. FIG. 1 shows a color image forming sheet 1 embodying the invention. The color image forming sheet 1 comprises a sheet substrate formed of, for example, paper or a synthetic resin and a color area of plural colors arranged regularly on the sheet substrate.

In the color image forming sheet 1 of this embodiment, as shown on a larger scale in FIG. 1, inks of three primary colors—cyan, magenta and yellow—are printed on the surface of the sheet substrate whose ground color is white to form color stripes C, M and Y of cyan, magenta and yellow, respectively, which are arranged in a predetermined order and in parallel with one another, thereby constituting a color area 7. Each of the color stripes C, M and Y has a predetermined certain width. In this embodiment the color area 7 is not printed over the whole surface of the substrate, but a portion of the substrate not covered with the color area 7 is exposed as a ground color area 8 of white color. The ground color area 8 comprises ground color stripes 9 of the exposed substrate portion extending in the direction perpendicular to the longitudinal direction of the color stripes C, M and Y which constitute the color area 7. Thus, the color stripes C, M and Y of the color area 7 are actually not continuous stripes in the longitudinal direction, but are aggregates of color dots divided into a large number of portions by the plural ground color stripes 9.

In other words, color dots of the primary colors are printed in a predetermined order longitudinally of the ground color stripes 9 and between adjacent ground color stripes 9 so that plural ground color stripes of exposed ground color of the substrate remain in parallel with each other on the substrate. In this way the color area 7 is constituted. In this case, the color dots adjacent to each other on both sides of a ground color stripe 9 in the direction perpendicular to the ground color stripe are of the same color.

The color image forming sheet 1 as a whole presents a different color by a color mixture of the three primary colors—cyan, magenta and yellow—which constitute the color area with the white color as the ground color of the substrate. The color and lightness of the entire sheet observed differ depending on various conditions, including reflection densities of printing inks of the primary colors, balance of each reflection density between colors, the quality and color of printing paper as an object to be printed, and the ratio of the area of the ground color area 8 to the area of the color area 7. For example, in the case of printing the color area 7 on a wood free paper of white color, and if the reflection densities of magenta, yellow and cyan which constitute the color stripes of the color area 7 are 0.30, 0.38 and 0.20, respectively, the color image forming sheet 1 is observed in a creamy color as a whole by a color mixture of those colors. For example, in the case of printing the color area 7 on a wood free paper of white color, and if the reflection densities of magenta, yellow and cyan which constitute the color stripes of the color area 7 are 0.36, 0.45 and 0.23, respectively, the color image forming sheet 1 is observed in a pinkish color as a whole by a color mixture of those colors. For example, in the case of printing the color area 7 on a wood free paper of white color, and if the reflection densities of magenta, yellow and cyan which constitute the color stripes of the color area 7 are 0.33, 0.37 and 0.33, respectively, the color image forming sheet 1 is observed in a grayish color as a whole by a color mixture of those colors. For example, in printing the color area 7 on a wood free paper of white color, and if the reflection densities of magenta, yellow and cyan which constitute the color stripes of the color area 7 are 0.40, 0.51 and 0.37, respectively, the color image forming sheet 1 is observed in a greenish color as a whole by a color mixture of those colors. In all of the cases just mentioned above, as compared with the case where the color area 7 is printed over the whole surface of the substrate without forming the ground color area 8, the color image forming sheet 1 of this embodiment having the ground color area 8 is high in lightness as a whole and can visually make a bright impression on any person looking at the sheet.

In this embodiment, the width of each of the color stripes C, M and Y, more specifically the width of each of the color stripes C, M and Y as measured in the longitudinal direction of the ground color stripes 9, can be set freely in the range of 0.05 to 0.22 mm in consideration of a visual effect. Accordingly, the color stripes C, M and Y are each repeated at a pitch of 0.15 to 0.66 mm in the longitudinal direction of the ground color stripes 9.

If the width of each of the color stripes C, M and Y is set at approximately 0.1 mm or less, since this width is smaller than the width capable of being resolved with the naked eye, a person who looks at the color image forming sheet 1 can no longer acknowledge visually that the color area 7 on the sheet 1 is constituted by the color stripes C, M and Y of three colors. In this way a color mixture of those colors is recognized naturally. When the width of each of the color stripes C, M and Y is set at 0.22 mm or more, it becomes difficult to effect the mixing of colors. This is based on the assumption that a card or the like is to be seen at a very short distance. But in the case of a color image object such as a poster which is seen at a relatively spaced position, a person who looks the sheet will feel a color mixture even if the color stripes C, M and Y which constitute the color area 7 on the color image forming sheet are still wider.

The width of each ground color stripe 9, more specifically the width of each ground color stripe 9 as measured in the direction perpendicular to the longitudinal direction of the ground color stripe, is set at 20% to 30% of the width of each of the color stripes C, M and Y in this embodiment. For example, when each color stripe width is 0.1 mm, the width of each ground color stripe 9 is set at 0.02 to 0.03 mm, and when each color stripe width is 0.2 mm, the width of each ground color stripe 9 is set at 0.04 to 0.06 mm. The above ratio is an optimum ratio which can make a bright ground color impression on a person looking at the sheet without drop of the developed color density.

For example, in the case of a reflection density of 0.4 to 0.41 in the absence of the ground color stripes 9, the reflection density exhibits a value of 0.38 to 0.4 in the presence of the ground color stripes 9.

The reflection density is an amount which represents to what degree a substance absorbs light at the time of reflection of the light. More specifically, given that the intensity of incident light is lo and that of reflected light is l, the reflection density D is expressed as log 10 (lo/l). The above reflection density has been measured by means of a reflection densitometer RD-920(S)(a product of Sakata Inks Co., Ltd.) whose measurement range is 0 to 2.50 in both density and calorimetric density.

If printing is performed in a superimposed state of a covering means on part of the color image forming sheet 1, the colors of uncovered portions of the color stripes C, M and Y are mixed to present a certain color. In this embodiment a white ink W is used as the covering means. For example, as shown in FIG. 2, if only the portions of yellow stripes Y on the color image forming sheet 1 are covered stripewise with the white ink W, the sheet 1 shows blue (or purple) as a whole by a color mixture of the residual cyan stripe S and magenta stripe M.

Figure 3A:
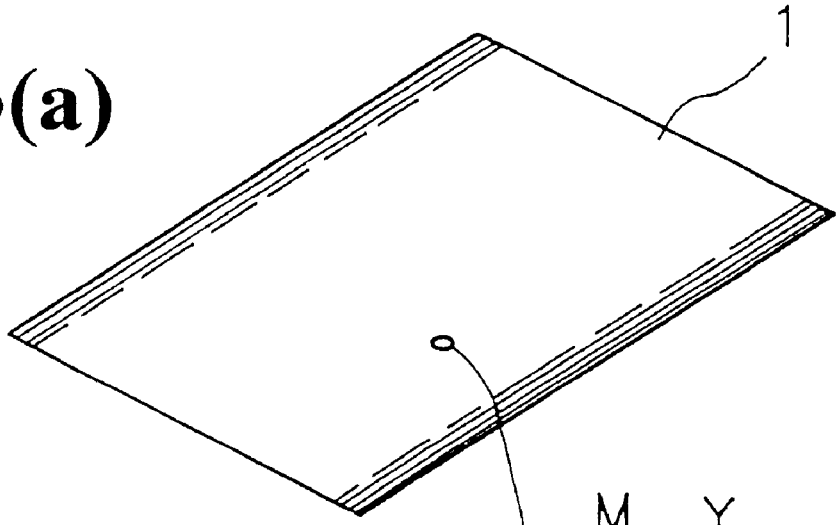
FIG. 3 shows a perspective view of the color image forming sheet with covering means printed thereon and a partially enlarged view thereof.
Figure 3B:
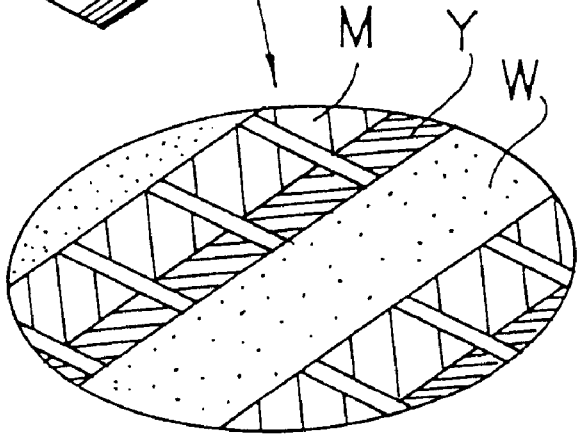

As shown in FIG. 3, if the white ink W is printed stripewise onto a part of the yellow stripe Y and the whole of the cyan stripe S on the color image forming sheet 1, the sheet 1 shows red as a whole by a color mixture of the residual portion of the yellow stripe Y and the residual magenta stripe M.

Figure 2A:
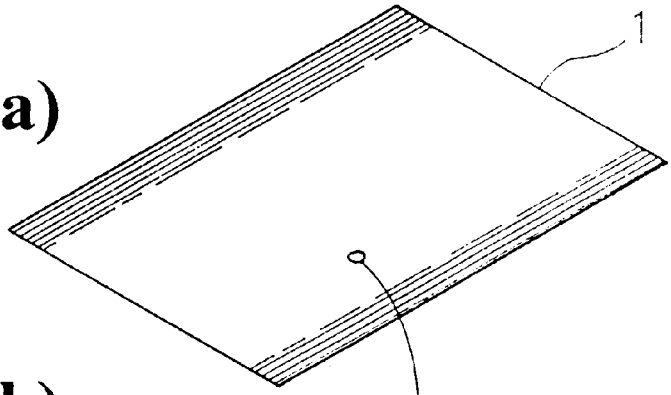
FIG. 2 shows a perspective view of the color image forming sheet with covering means printed thereon and a partially enlarged view thereof.
Figure 2B:
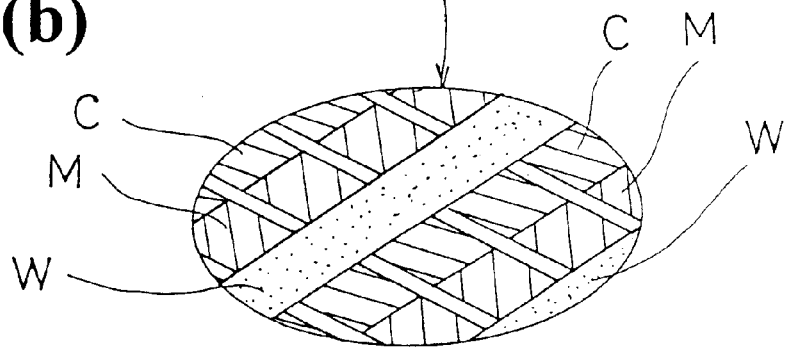

FIGS. 2 and 3 show examples in which a desired color is obtained by printing the white ink W stripewise on the color image forming sheet 1 in conformity with the stripe pattern of the sheet. It is also possible to obtain colors other than those shown in these examples. The color image forming sheet 1 will show desired colors by changing the position and width of the white ink W to be printed on the sheet. It is also possible to change the printing pattern of the white ink W so that different colors are presented at various positions in the sheet 1. For example, a full-color image can be presented in the sheet 1.

The color area 7 is not printed over the whole surface of the substrate, but portions of the substrate are exposed in the color area 7 to constitute the ground color area 8. Therefore, when white ink as covering means is printed to cover the color area 7, it soaks into the substrate portions in the ground color area 8 easily and hence dries quickly. If the whole surface of the substrate is covered with the color area 7, the white ink as covering means is printed superimposedly on the constituent inks of the color area 7. Since the white ink is difficult to be absorbed by the constituent inks of the color area 7, it takes a relatively long time of the white ink to dry.

Figures 4A, 4B, 4C, 4D, 4E, 4F:
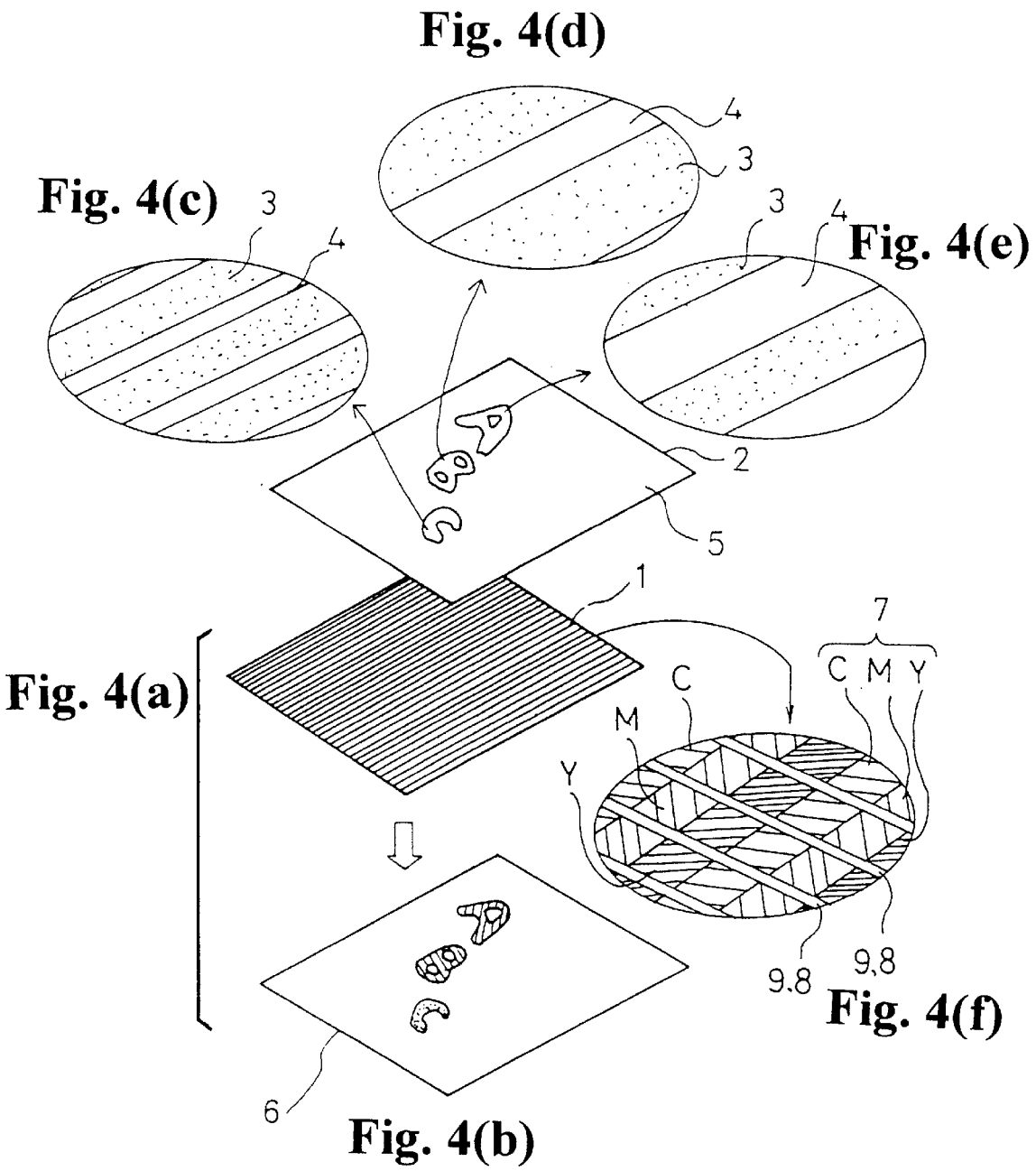
FIG. 4 is a perspective view showing a cover sheet provided with white stripe-like covering means, also showing a color image forming sheet and further showing a color image object obtained by placing both sheets one upon the other and partially enlarged views of the cover sheet and the color image forming sheet.

FIG. 4 shows an example in which a single color image forming sheet 1 is covered with white color to present color images of plural colors. In this case, a white covering means, e.g. white ink, may be applied in a predetermined pattern directly onto the sheet 1 by a suitable means such as, for example, printing or transfer. In the example shown in this figure, desired image patterns comprising white stripe portions and transparent portions are formed on a transparent cover sheet 2 having a covering means of white color and then the cover sheet with the image patterns formed thereon is put on the sheet 1.

The cover sheet 2 shown in FIG. 4 comprises a transparent sheet and a white covering means which covers part of the transparent sheet. The area wherein the desired images (the letters ABC in the illustrated example) are formed comprises white stripe portions 3 and transparent portions 4, while the other area is a white solid area 5.

As shown in enlarged views in FIG. 4, the white stripe portions 3 and the transparent portions 4 both constituting the images A, B and C are different in width and spacing for each image.

By putting the cover sheet 2 on the color image forming sheet 1 there is obtained a color image object 6 wherein images A, B and C of different colors are formed in the white ground color. Although the colors of the images A, B and C are not specified in this example, it goes without saying that desired colors can be presented by changing the width and spacing of the white stripe portions 3.

In the example shown in FIG. 4 there may be made a modification such that the whole surface of a transparent sheet is covered beforehand with a white covering means and then the portions of the covering means corresponding to images are removed stripewise using such patterns as will afford desired colors. Or a white solid area and images may be formed directly on a transparent sheet using a white covering means. According to a further modification, a white stripe- like covering means is provided on only the portions of a transparent sheet corresponding to images and the other area is left transparent without disposing anything. In this case, images of desired colors are presented in the ground color (a color presented by a color mixture of the three colors—cyan, magenta and yellow—with white color which is the ground color of the substrate) of the color image forming sheet 1.

Reference will now be made to a color image forming apparatus wherein a portion of the color image forming sheet 1 is covered with a covering means of a predetermined pattern, allowing an image of a desired color to be presented by a color mixture of uncovered colors. As a method for forming such a covering means there may be adopted a method wherein white ink is printed on the color image forming sheet as in the examples described above with reference to FIGS. 2 and 3.

Figure 5A:
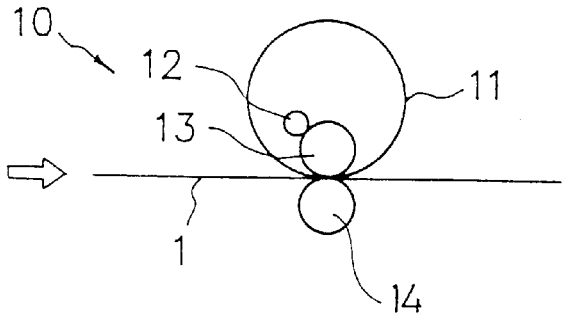
FIG. 5(*a*) is a diagram showing a schematic structure of a color image forming apparatus which utilizes a rotary type stencil printing and also 5(*b*) show a style of a color image forming sheet is conveyed.
Figure 5B:
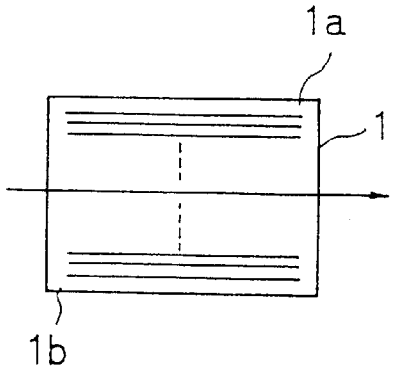

More specifically, there may be used such a stencil type rotary printing apparatus 10 as illustrated in FIG. 5(*a*). A stencil drum 11 having an ink-permeable peripheral wall is driven for rotation about its own axis by a drive means (not shown). In the interior of the stencil drum 11 are provided a doctor roller 12 and a squeegee roller 13 both constituting part of an ink supply means, whereby white ink as a covering means can be squeezed to the inner peripheral surface of the stencil drum 11 in synchronism with the operation of the stencil drum 11.

Onto the outer peripheral surface of the stencil drum 11 is wound a perforated stencil sheet. A stripe pattern of white ink to be printed onto the color image forming sheet 1 is perforated in the stencil sheet. Of course, the stripe pattern formed on the stencil sheet corresponds to the color stripes C, M and Y of three primary colors formed on the sheet 1. The stencil sheet is wound onto the stencil drum 11 in such a manner that the longitudinal direction of the stripe pattern formed on the stencil sheet and the moving direction of the drum peripheral surface coincide with each other.

Under the stencil drum 11 is disposed a press roller 14 as a pressing member in contact with or in close proximity to the stencil drum 11. The color image forming sheet 1 as printing paper, which is to be provided as a color image object after printing, is fed between the stencil drum 11 and the press roller 14 which are rotated in synchronism with each other. As shown in FIG. 5(*b*), the color image forming sheet 1 is fed so that the longitudinal direction of the color stripes C, M and Y as constituents of the color area is coincident with the direction in which the sheet is fed by both stencil drum and press roller.

Upon operation of the rotary printing apparatus 10 constructed as above, white ink is printed in a predetermined stripe pattern from the stencil sheet onto the color image forming sheet 1 fed between the stencil drum 11 and the press roller 14. As a result, an image of a desired color is formed on the sheet 1.

In the printing operation using the rotary printing apparatus 10, it is important to effect registration between the stencil sheet and the color image forming sheet 1 in the transverse direction perpendicular to the sheet conveying direction. If a relative positional relation of the two is displaced, the presented color will differ. In view of this point, as shown in FIG. 5(*b*), if the positions of the three primary color stripes C, M and Y are detected with sensors at two diagonal corners 1*a* and 1*b* on the sheet 1, it becomes possible to precisely control the position of the sheet in the aforesaid transverse direction and hence possible to realize a desired color accurately.

Figure 6:
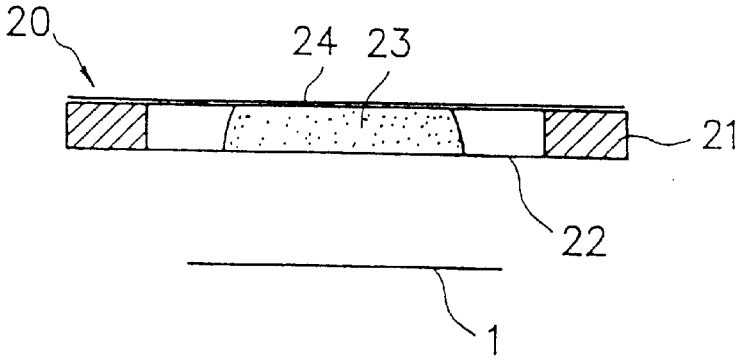
FIG. 6 is a schematic structural diagram of a color image forming apparatus which utilizes a pressing type stencil printing.

According to another method for printing white ink on the color image forming sheet 1, there may be used such a stencil and pressing type printing apparatus 20 as shown in FIG. 6. A perforated stencil sheet 22 is affixed to the underside of a frame 21. The stencil sheet 22 has a perforated stripe pattern of white ink to be printed onto the color image forming sheet 1. Of course, the stripe pattern formed on the stencil sheet 22 corresponds to the pattern of the three primary color stripes C, M and Y formed on the sheet 1 and is formed so that an image of a desired color is presented on the sheet.

White ink 23 is put on the stencil sheet 22, and a cover 24 is provided on the upper surface of the frame 21 to cover the white ink 23. The pressing type printing apparatus 20 is placed by positioning onto the color image forming sheet 1 and then pressed at a predetermined pressure, whereby the white ink 23 is printed in a predetermined stripe pattern onto the sheet 1 through the stencil sheet 22. As a result, an image of a desired color is formed on the sheet 1. Also for registration of the color image forming sheet 1 and the stencil sheet 22 in the pressing type printing apparatus 20 of this construction there may be used the same registration means as that used in the foregoing rotary printing apparatus 10.

As means for partially covering the color area 7 and the ground color area 8 on the color image forming sheet to present a desired color there may be adopted a method wherein covering means is provided on the sheet 1 by any other method than stencil printing.

Figure 7:
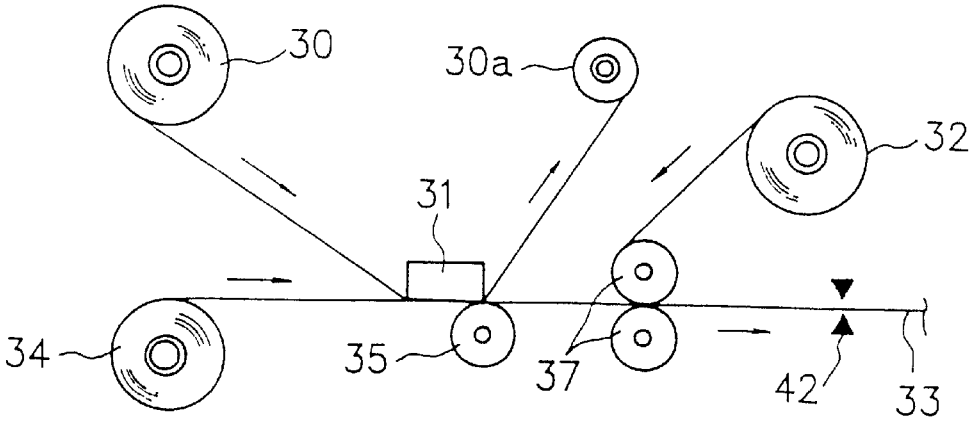
FIG. 7 is a schematic structural diagram of a color image forming apparatus which uses a ribbon-like color image forming sheet, a white transfer ribbon and a thermal head.

FIG. 7 illustrates a color image forming apparatus in which a white transfer ribbon 30 and a thermal head 31 are used to form a predetermined stripe pattern of white color on a rolled color image forming sheet 32 and afford a color image object 33 of a desired color. The transfer ribbon 30, which is rolled, and a rolled transparent film 34 are lapped together and conveyed while being held between the thermal head 31 and a platen roller 35.

Figure 8:
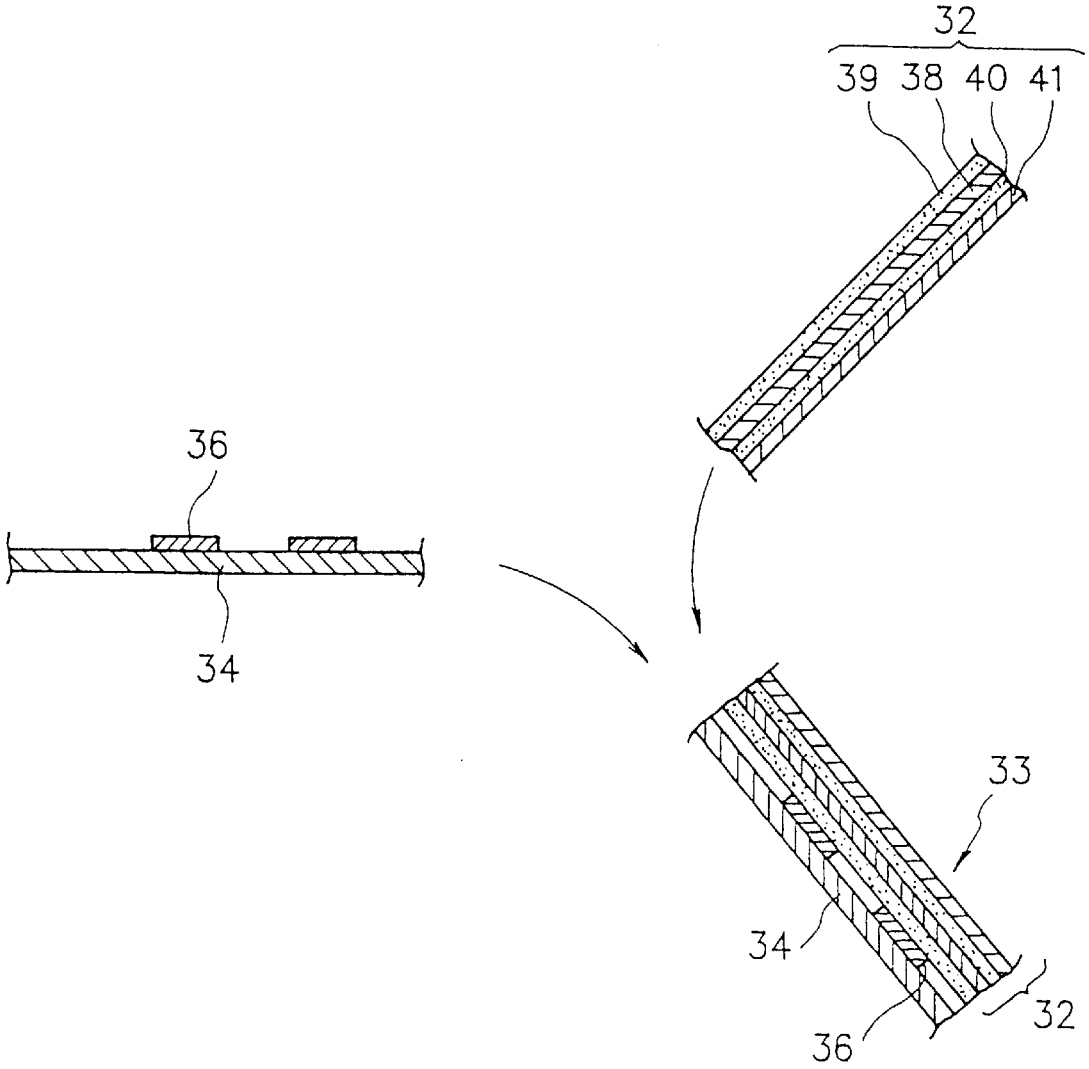
FIG. 8 is an enlarged sectional view of a color image object formed in the apparatus shown in FIG. 7, and of other components.

In accordance with a drive signal the thermal head 31 transfers white ink 36 of the transfer ribbon onto the transparent film 34, as shown in FIG. 8. The pattern of the white ink 36 thus transferred onto the transparent film 34 corresponds to the pattern of three primary color stripes C, M and Y formed on the color image forming sheet 32 which will be described later, and is designed so that a desired color is presented on the sheet 32 after printing.

As shown in FIG. 7, a transfer ribbon 30*a* after the transfer is wound up after leaving the thermal head 31. The transparent film 34 with white ink 36 transferred thereon is fed to pressure feed rollers 37, to which is also fed the rolled color image forming sheet 32. The transparent film 34 and the sheet 32 are united by the rollers 37.

As shown in FIG. 8, the color image forming sheet 32 has a sheet portion 38 with color stripes C, M and Y of three primary colors formed on the front side, an adhesive layer 39 formed on the front side of the sheet portion 38, and a release paper 41 provided on the back side of the sheet portion 38 through an adhesive layer 40. The construction of the three primary color stripes C, M and Y is the same as in the example described previously in connection with FIG. 1.

The white ink 36-transferred side of the transparent film 34 is laminated to the adhesive layer 39 formed on the front side of the color image forming sheet 32, whereby both are united. When seen from the transparent film 34 side, the white ink 36 of a predetermined pattern partially overlaps the three primary color stripes C, Y and Y on the sheet 32. Consequently, the sheet 32 affords a color image object 33 of a desired color presented by a color mixture of colors not covered with the white ink 36.

The color image object 33 discharged from the pressure feed rollers 37 is cut at desired positions into a desired length with a cutter 42, and the release paper 41 is separated from the resulting color image object 33, which can then be affixed to any object.

In this apparatus, the stripe pattern of the white ink 36 and the pattern of the color stripes C, M and Y on the color image forming sheet 32 are both parallel to the conveying direction in the apparatus. Registration of both patterns can be effected by adjusting the axial position of the rolled color image forming sheet 32.

There also may be used a color image forming apparatus in which white toner is printed on the color image forming sheet by means of a laser beam printer. Further, a thermal transfer ribbon of white ink may be provided in a printer of a word processor having a thermal head and a pattern formed on the display of the word processor may be printed with white ink onto the color image forming sheet to form such a desired color image as mentioned above.

In the examples described above, since the color stripes C, M and Y which constitute the color area on the color image forming sheet 1 (32) and the stripe pattern of the white covering means which cover those color stripes are parallel to each other, the color presented within a predetermined area is constant. However, if both stripe patterns are put one upon the other in a mutually inclined state, there is obtained a rainbow-colored effect by continuous change of plural colors. This is presumed to be correct because the covered state of the color stripes C, M and Y is not constant but varies continuously in their longitudinal direction and hence more effect is created. Even without such mutual tilting of both stripe patterns, the same effect is obtained by making the stripe pattern width on the covering means nonuniform.

In the above examples part of the color stripes C, M and Y of three primary colors—cyan, magenta and yellow—is covered with a white covering means to present a desired color. This is an example of subtractive color mixture in which a printed product is observed with reflected light.

The present invention is also applicable to additive color mixture based on color mixing of transmitted light rays. In the case of additive color mixture, blue, red and green are used as three primary colors, and as covering means there may be used such a light non-transmitting covering means as black ink for example. For forming a color image object from an additive color mixture, color stripes C, M and Y are formed in a predetermined pattern on a transparent sheet substrate using light transmitting inks of the three primary colors, while the area with color stripes C, M and Y not formed therein is left as it is as a transparent ground color area 8*a*, to constitute a color image forming sheet 1*a*. The sheet 1*a*, when observed with white transmitted light, is seen in a white color-developed state as a whole.

On the color image forming sheet 1*a* is printed a stripe pattern with black ink. Alternatively, a stripe pattern whose phase substantially matches the color stripes C, M and Y on the color image forming sheet is printed with black ink on a light-reflective sheet of white color for example to constitute a covering means, then this covering means is put on the color image forming sheet 1*a*. In both cases, the sheet portion overlapped with the black ink pattern does not transmit light and therefore the color of the sheet 1*a* is determined by a color mixture of transmitted light rays in the portion not covered with black ink. Thus, also in the case of additive color mixture it is possible to form a desired image of a desired color on the color image forming sheet 1*a*.

In such additive color mixture, the light non-transmitting covering means is not limited to black ink, but there may be used any other ink insofar as the ink does not transmit light. The covering means is not limited to the use of ink. The portion to be rendered light non-transmissive may be flawed to make it difficult to transmit light.

Although in the above examples there are used three primary colors of cyan, magenta and yellow on the color image forming sheet, it is not always necessary to use such three primary colors as constituent colors of the color area in the present invention. For example, even with use of two colors out of the three primary colors, it is possible to present a color of a three- or more-color mixture. Further, it is not always necessary that the color area formed on the color image forming sheet be constituted by primary colors. Any other color is adoptable. For example, various intermediate colors other than primary colors, metallic luster colors, including gold and silver colors, pearl luster color, fluorescent color, and colors of inks containing metallic powders, can be adopted selectively in consideration of visual effect. For example, if fluorescent color is adopted, the whole of the resulting image looks clear and bright.

In the color image forming sheet according to the present invention, since part of the substrate not covered with the color area serves as a ground color area, the color of the ground color area is the same as the color of the substrate. In the examples shown above, the ground color area was white or transparent. In the present invention the substrate color is not limited those used in the above examples but there may be used any other color. In other words, on a substrate having a ground color other than white and transparence there may be printed the foregoing color area so as to permit appearance of a ground color area in a predetermined pattern.

Although in the above-described examples the color of the covering means formed by printing on the color image forming sheet or of the covering means provided on the cover sheet is white or black, it is not always required for the covering means used in the present invention to be black or white. The foregoing various colors used in the color area on the color image forming sheet or in the ground color area may each be adopted as the color of the covering means while taking into account the visual effect induced by combination with the colors used on the color image forming sheet. In the case where a black covering means is superimposed on the color image forming sheet, the colors of the color area which constitutes the sheet are microscopically surrounded with a black pattern, so that the contour of the image presented on the sheet becomes clearer than in the use of a white covering means.

In the above-described examples a stripe pattern is adopted as a pattern of the colors which constitute the color area on the color image forming sheet, a stripe pattern perpendicular to the color area is adopted as a pattern of the ground color which constitutes the ground color area, and a covering means of a stripe pattern parallel to the color stripes of the color area is placed on the color image forming sheet to form an image of a desired color. In this case, the positioning of the color area pattern and that of the covering means are not required to be highly accurate at least in the longitudinal direction of the color stripes, and a desired color can be realized precisely by making registration in the direction perpendicular to the color stripes.

Although a stripe is effective as the pattern of colors forming the color area in the invention, this does not constitute any limitation. For example, there may be adopted a pattern comprising very small dots of plural colors arranged regularly. For example, the dots may be circular or square. How to arrange the dots is not specially limited if only the arrangement can afford a natural color mixture when observed with the naked eye. In this case, the background other than the color dots is used as a ground color area of the substrate, and the covering means to be placed on the color pattern is constituted by a pattern comprising similar very small dots whose phase substantially matches the pattern of the color area.

Now, with reference to FIGS. 9 to 12, a description will be given of a color image forming apparatus according to another embodiment of the present invention. In this color image forming apparatus, indicated at 50, a color area constituted by color stripes C, M and Y of three primary colors—cyan, magenta and yellow—is printed on a printing paper 51 as a substrate to be printed so that a ground color area appears intermediate, to form a color image forming sheet 1. Subsequently, a black ink as covering means is printed on the color image forming sheet 1 in such a manner that its phase substantially matches the color stripes C, M and Y, whereby an image of a desired color can be presented on the sheet 1.

The image forming apparatus 50 has a paper feed belt 52 acting as means for conveying the printing paper 51. Above the paper feed belt 52 is provided a color area forming section 53 at a front half position in the paper conveying direction. The color area forming section 53 has three stripe printing portions 54 for printing color stripes C, M and Y of three primary colors—cyan, magenta and yellow—continuously on the printing paper 51 to form the color image forming sheet 1.

Figure 10:
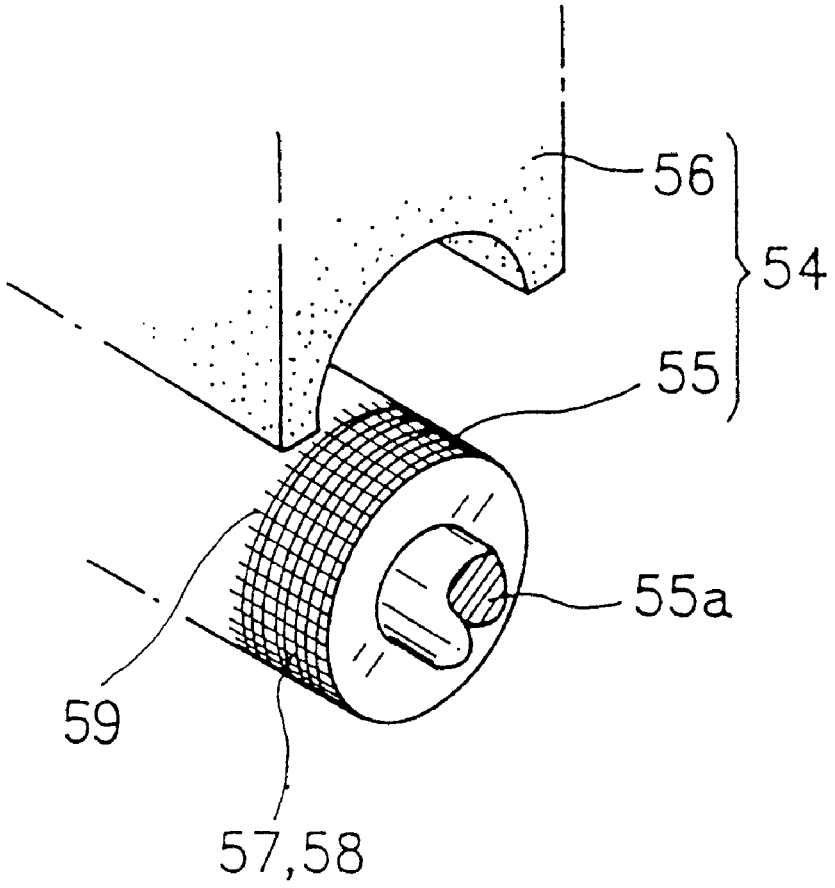
FIG. 10 is an enlarged perspective view of a stripe printing section in the color image forming apparatus shown in FIG. 9.

As shown in FIG. 10, each stripe printing portion 54 has a printing roller 55 and an ink pad 56 for the supply of ink to the printing roller 55. Although the ink pad 56 and the printing roller 55 are spaced apart from each other in FIG. 10, both come into contact with each other when the stripe printing portion is in operation. To the ink pad 56 is supplied a color ink from an ink supply means (not shown). The printing roller 55 has a rotating shaft 55*a* extending in the direction perpendicular to the conveying direction of the printing paper 51. The printing roller 55 is rotated in synchronism with the operation of the paper feed belt 52 and performs printing for the printing paper 51 while holding and conveying the paper between it and the belt 52.

Figure 11:
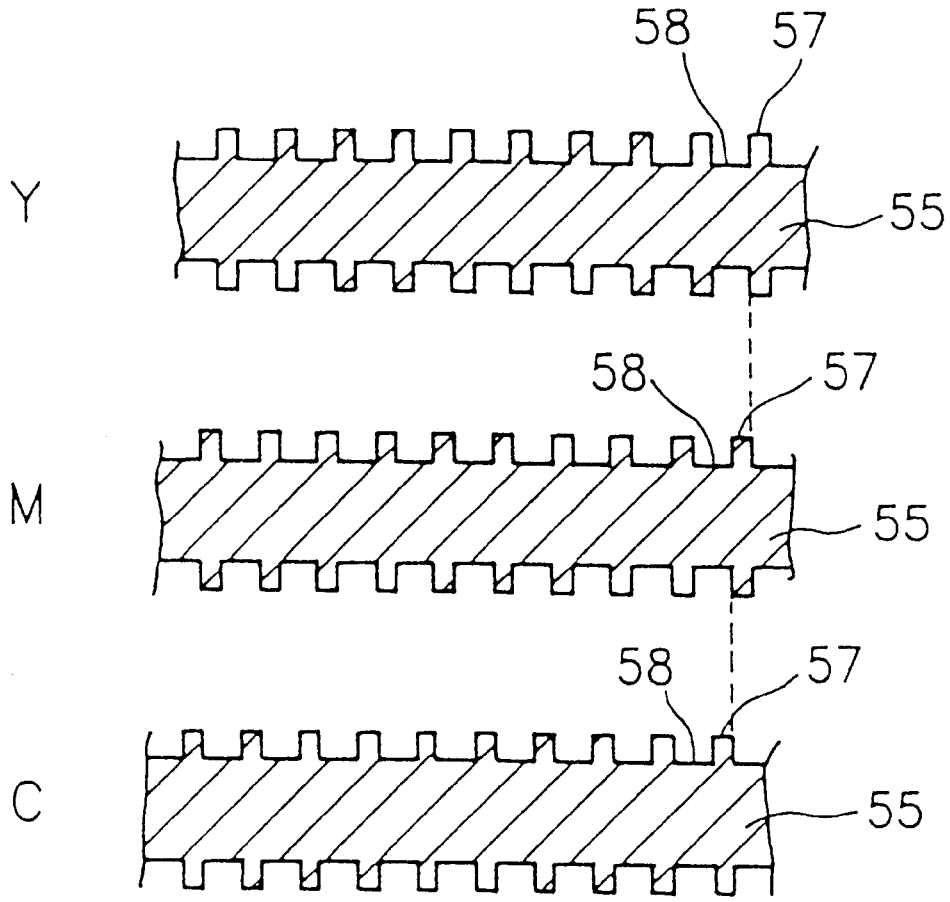
FIG. 11 is a sectional view showing the structure of each printing roller disposed in the stripe printing section of the color image forming apparatus.

A large number of projections 57 of a predetermined width parallel to the conveying direction of the printing paper 51 are formed on the peripheral surface of the printing roller 55 in a sandwiched relation to vertical grooves 58 of a predetermined width. In this embodiment, as shown in FIG. 11, the width of each projection 57 is 62.5 $\mu$m and that of each vertical groove 58 is 125 $\mu$m. The projections 57 on the printing rollers 56 in the three stripe printing portions 54 are each displaced one pitch (62.5 $\mu$m) in the direction of the rotating shaft 55*a* of each printing roller 55, whereby the color stripes C, M and Y of cyan, magenta and yellow can be printed on one sheet of printing paper 51 continuously and closely without leaving any space in the width direction.

As shown in FIG. 10, a large number of horizontal grooves 59 parallel to the axis of the rotating shaft 55*a* are formed at predetermined spacings in the peripheral surface of the printing roller 55. Ink does not adhere to the portions of the printing paper 51 corresponding to the horizontal grooves 59, but the ground color of the printing paper 51 appears. The portions of the printing paper constitute a ground color area 8. The color stripes C, M and Y are partitioned into plural dots in the longitudinal direction by the ground color area 8 formed by the horizontal grooves 59. The width of the ground color area is 20 $\mu$m.

The ground color area 8 not only functions to brighten the whole of the color image forming sheet 1 as mentioned previously but also functions as a blot preventing portion when a color area 7 is printed in forming the sheet 1. In the case of printing a covering means on the color image forming sheet 1 after formation of the same sheet, the ground color area 8 is also effective in absorbing ink of the covering means to quicken the drying of the covering means.

Figure 15A:
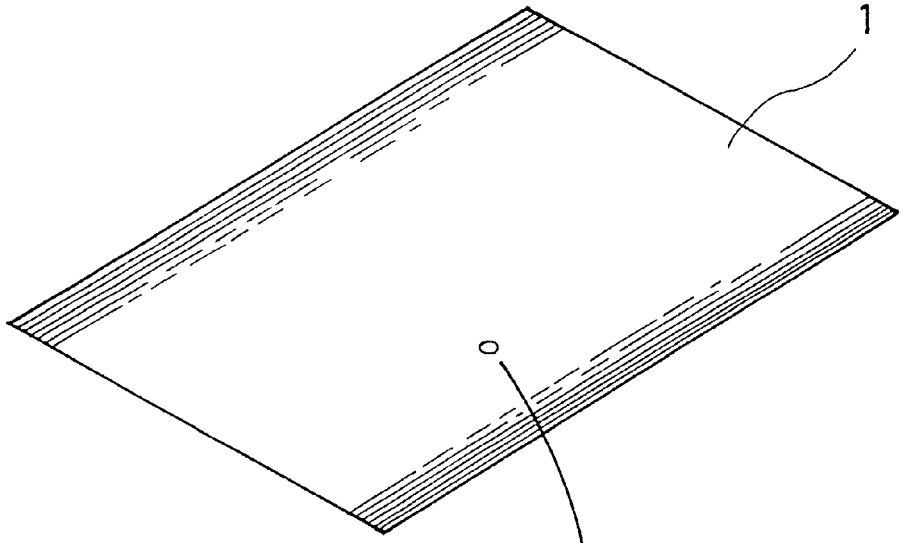
FIG. 15 is a perspective view showing another morphological example of color stripes C, M, Y and ground color stripe on a color image forming sheet according to the present invention.
Figure 15B:
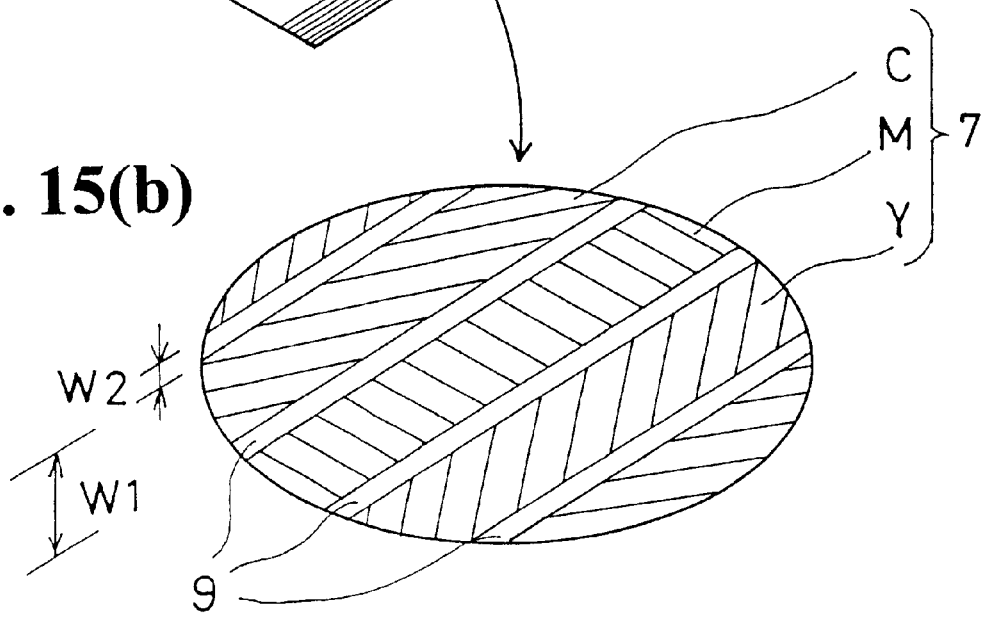

The color image forming apparatus 50 forms the color image forming sheet 1 which has a color area consisting of three primary color stripes C, M and Y and the ground color area 8 consisting of ground color stripes 9 perpendicular to the color area. With the pitch of the projections 57 on the printing roller 55 in the color image forming apparatus 50 left as it is, the width of each projection 57 may be set at 50 $\mu$m, and as shown in FIG. 15, a ground color area consisting of ground color stripes parallel to the color stripes C, M and Y may be formed so that the ground color stripes are each positioned between adjacent color stripes of C, M and Y in the color area formed on the printing paper. In this case, the width W1 of each of the color stripes C, M and Y is set at 50 $\mu$m and the width W2 of each ground color stripe 9 parallel to the color stripes C, M and Y is set at 12.5 $\mu$m.

Figure 9:
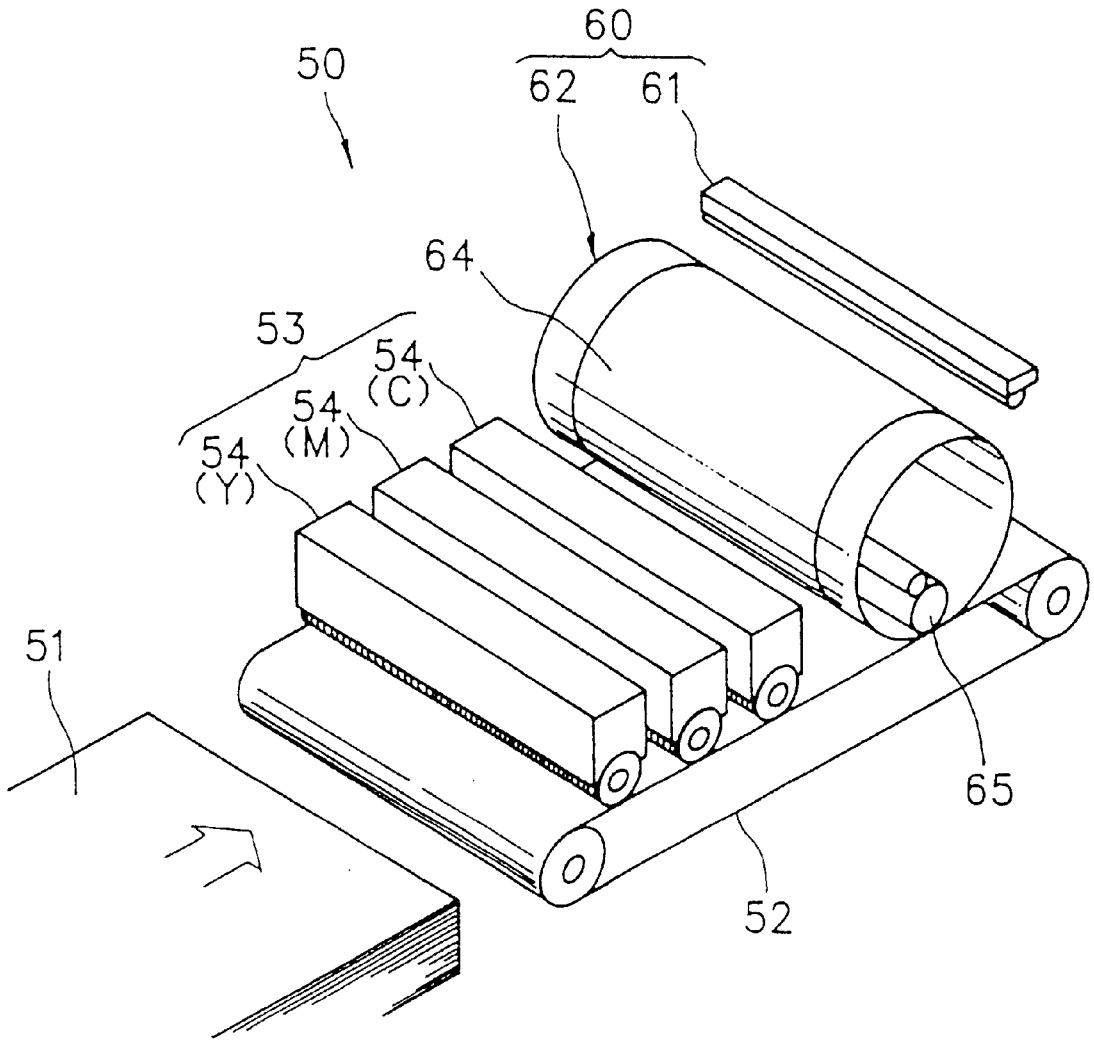
FIG. 9 is a perspective view of a color image forming apparatus according to another embodiment of the present invention.

As shown in FIG. 9, a covering area forming section 60 is provided above the paper feed belt 52 and at a latter half position of the belt in the paper conveying direction. The covering area forming section 60 has a thermal head 61 for thermally perforating a stencil sheet S and a stencil printing portion 62 which is driven with the perforated stencil sheet S loaded thereon.

Figure 12:
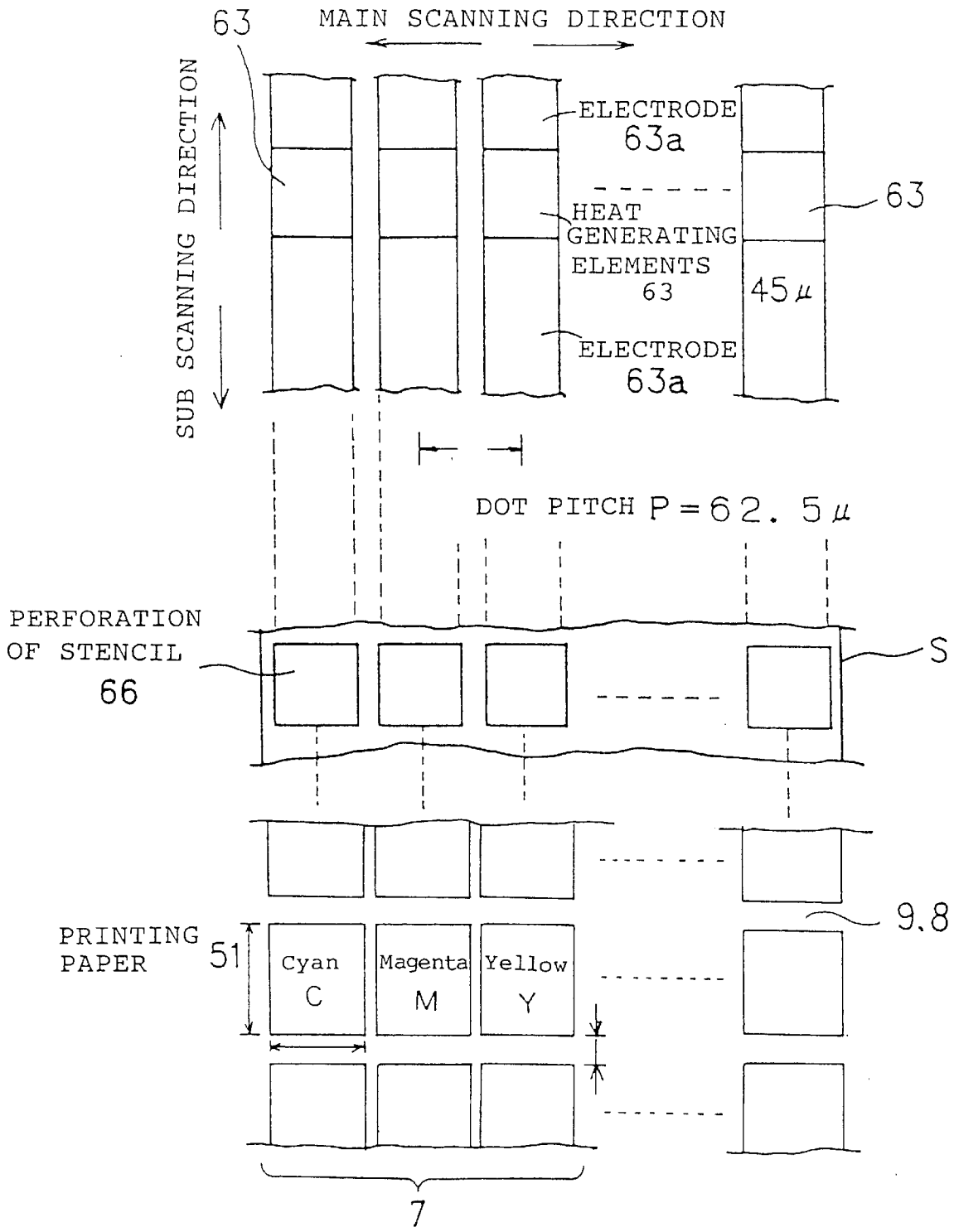
FIG. 12 is a diagram showing a relation among heat generating elements, master perforations and printing paper which are used in the color image forming apparatus illustrated in FIG. 9.

As shown in FIG. 12, the thermal head 61 has a large number of heat generating elements 63 arranged at a predetermined pitch in the main scanning direction. The heat generating elements 63 are each disposed on an electrode 63*a*. In this embodiment, each heat generating element 63 is 48 to 60 $\mu$m long in the sub scanning direction parallel to the longitudinal direction of the three primary color stripes C, M and Y printed on the printing paper 51 and 45 $\mu$m long in the main scanning direction perpendicular to the sub scanning direction. The pitch of the heat generating elements 63 in this embodiment is substantially the same as the pitch of the color stripes C, M and Y on the color image forming sheet formed in the color area forming section 53. That is, the heat generating elements are arranged at a pitch of 62.5 $\mu$m in the main scanning direction.

The stencil printing portion 62 has a printing drum 64 which is rotated about its own axis. On the peripheral surface of the printing drum 64 is formed an ink-permeable printing area, and the perforated stencil sheet S is loaded onto the peripheral surface of the printing drum 64 including the printing area. In the interior of the printing drum 64 is disposed an ink supply means 65 for the supply of ink to the inner peripheral surface of the printing drum 64. The printing drum 64 is rotated in synchronism with the paper feed belt 52 and performs printing for the printing paper 51 while holding and conveying the paper 51 between it and the belt 52.

Though not shown, the color image forming apparatus 50 of this embodiment has a read means for reading an original image of full color to be printed and a thermal head drive unit for processing image data read by the read means and generating a thermal head driving signal. The thermal head drive unit permits perforation of the stencil sheet S so that an appropriate black color printing is performed on each of the three primary color stripes formed on the printing paper 51 and the original full-color image can be reproduced by a color mixture of colors not covered with the black color.

As shown in FIG. 12, the apparatus of this embodiment is constructed in such a manner that perforations (master perforations 66) in the perforated stencil sheet S loaded on the stencil printing portion 62 and the color stripes C, M and Y in the color area formed on the printing paper 51 become opposed to each other. Registration of the master perforations 66 formed in the stencil sheet S on the printing drum 64 and the color stripes C, M and Y on the printing paper 51 fed from the color area forming section 53 may be made substantially by the same method as in the previous embodiment explained in connection with FIG. 5(*b*) for example.

According to the color image forming apparatus 50 of this embodiment, the number of stencil sheet S used is one, that of the printing drum 64 used is also one, and the stencil printing operation is performed only once, nevertheless it is possible to form a full-color image.

Description is now directed to an embodiment of forming a desired color image by printing a black covering means on a color image forming sheet which is provided in advance. In this embodiment there is used the stencil and pressing type printing apparatus 20 shown in FIG. 6. How to use the apparatus 20 is about the same as in the previous embodiment described in connection with FIG. 6, provided black ink is used instead of white ink. The color image forming sheet used is the same as that shown in FIG. 1.

Figure 13:
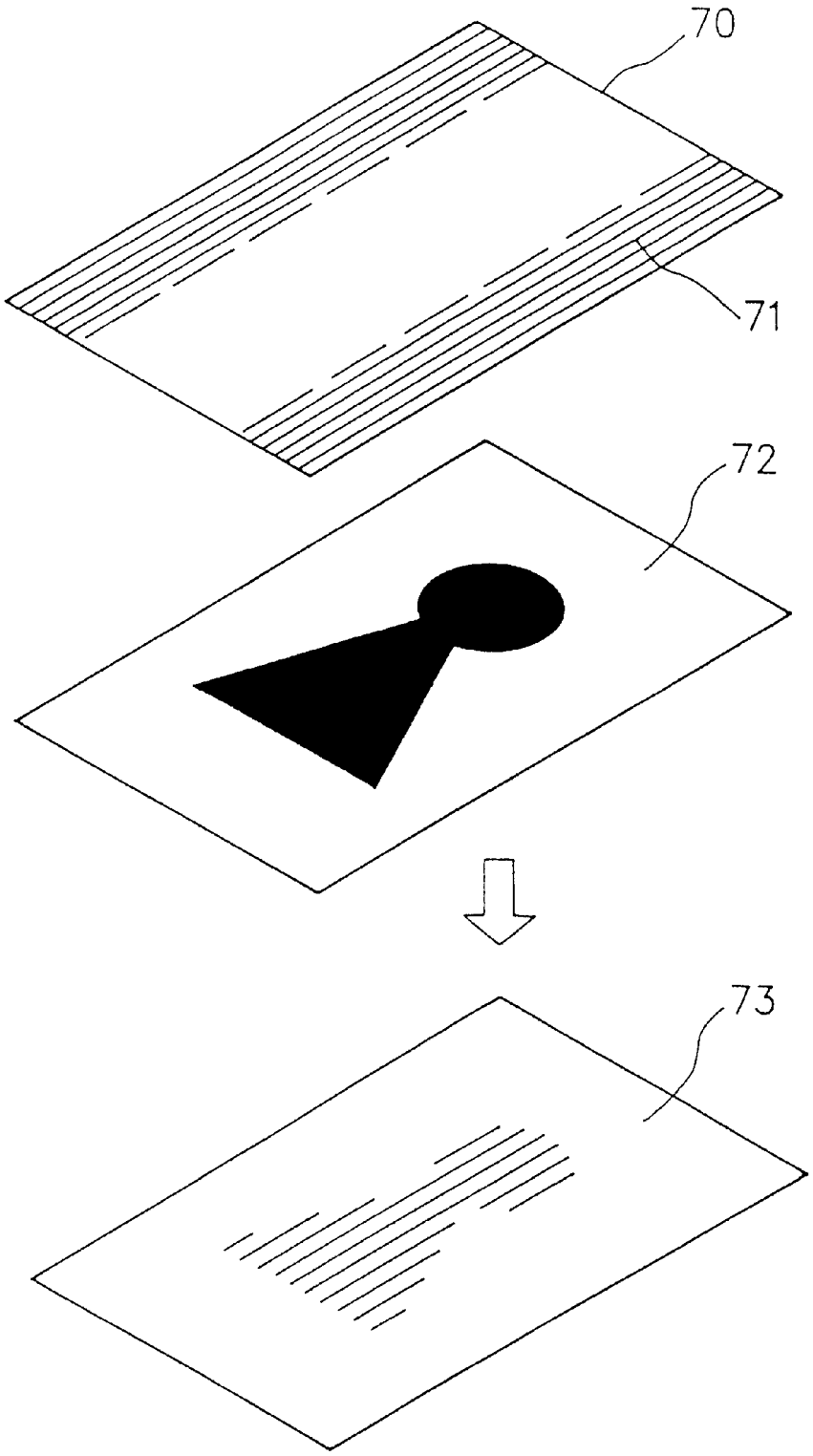
FIG. 13 is a diagram which explains the procedure of forming stripe-like covering means of black color using an original image.

The method for perforating the stencil sheet S used will now be described with reference to FIG. 13. Stripes whose phase matches the primary color stripes C, M and Y in the color area of the color image forming sheet are formed on a light transmitting film using a light reflective color. In this embodiment, white stripes 71 are formed on a transparent sheet 70 as the light transmitting film. The transparent sheet 70 with the white stripes 71 thereon is placed on an original 72 and a copy is taken electrophotographically to form a second original 73 constituted by black stripes. The phase of the black stripes which constitute the second original 73 substantially matches the primary color stripes C, M and Y in the color area of the color image forming sheet. The stencil sheet S is placed on the second original 73 comprising the black stripes and flash light is radiated from the stencil sheet S side, causing the black color area of the second original 73 to generate heat to thereby perforate the stencil sheet S thermally. It is also possible to form a color image by forming a stamp with use of the thus-perforated stencil sheet S and pressing the stamp onto the color image forming sheet. In this case, at every pressing of the stamp the positional relation of the black stripes on the stamp changes relative to the color stripes C, M and Y on the color image forming sheet, so that the color of the resulting color image changes delicately at every stamping and thus it is possible to enjoy various colors and changes thereof.

The method of printing a black covering means on the pre-provided color image forming sheet and presenting a desired color may be almost the same as the method illustrated in FIGS. 7 and 8. Or a black toner may be deposited on the color image forming sheet by means of a laser beam printer. There may be adopted a method wherein a thermal printing ribbon of black ink is provided in a printer of a word processor having a thermal head and a pattern formed on the display of the word processor is printed with black ink onto the color image forming sheet to form an image of a desired color. Further, there may be adopted a method wherein one side of a transparent sheet with black covering means printed thereon is formed as an adhesive side and this adhesive side is laminated as a seal to the color image forming sheet so that various colors are presented. In this case, only a slight deviation in the seal affixing position on the color image forming sheet causes delicate changes in color and therefore it is possible to enjoy a variety of colors and changes thereof.

The following description is now provided about an embodiment in which on the color area 7 side of the color image forming sheet 1 there is formed a discoloring layer or a coloring layer as a covering means over the whole surface or in a pattern substantially matching the pattern of the color area, and the discoloring or coloring layer is allowed to discolor or develop color to hide part of the color area and present a desired color.

For forming the discoloring layer or the coloring layer there may be used, for example, a heat-sensitive color coupler, a photochromic agent, a thermochromic agent, a piezochromic agent, or liquid crystal.

The photochromic agent undergoes a change in color when exposed to ultraviolet rays and resumes its original color when placed in a dark place. For example, therefore, if a photochromic agent which discolors to black is printed on color stripes C, M and Y so as to cover the other colors than a desired color, only the portion covered with the photochromic agent turns to black when exposed to ultraviolet rays, while only the color of the portion not covered with the photochromic agent is presented, and thus this phenomenon is observed as if a color image emerged from a place where there is nothing. When ultraviolet rays are extinguished, the original state is resumed and the image disappears. The thermochromic agent and the piezochromic agent exhibit the same phenomenon as above under the application of heat and pressure, respectively. In the case of liquid crystal, the same effect is attained by heat or by an electric field.

Reference will now be made to the heat-sensitive color coupler used as the discoloring layer or the coloring layer. In the heat-sensitive color coupler is contained one or both components of a leuco dye and a color developer. A leuco dye as a coupler component and an acidic substance as a developer component are melted or mixed together under heating, with the result that the leuco dye changes from colorless to colored state.

As the leuco dye there may used any of those which have heretofore been used in the production of thermal paper. For example, fluoran-, triphenylmethane- and spiropyran-based leuco dyes are preferred. More concrete examples include:

3-cyclohexylamine-6-chlorofluoran,
3-dimethylamino-5,7-dimethylfluoran,
3-dimethylamino-7-chlorofluoran,
3-dimethylamino-7-methylfluoran,
3-dimethylamino-7,8-benzfluoran,
3-dimethylamino-6-methyl-7-chlorofluoran,
3-diethylamino-7-(o-chloroanilino)fluoran,
3-dibutylamino-7-(o-chloroanilino)fluoran,
3-(N-methyl-N-amyl)amino-6-methyl-7-anilinofluoran,
3-(N-methyl-N-cyclohexyl)amino-6-methyl-7-anilinofluoran,
3-diethylamino-6-methyl-7-anilinofluoran,
3-morpholino-7-(N-propyl-trifluoromethylanilino) fluoran,
3-pyrrolidino-7-trifluoromethylanilinofluoran,
3-pyrrolidino-7-(di-p-chlorophenyl) methylaminofluoran,
3-diethylamino-5-chloro-7-(α-phenylethylamino) fluoran,
3-diethylamino-5-methyl-7-(α-phenylethylamino) fluoran,
3-diethylamino-7-piperidinofluoran,
3,3-bis(p-dimethylaminophenyl)-phthalide,
3,3-bis(p-dibutylaminophenyl)-phthalide,
3,3-bis(p-dimethylaminophenyl)-6-dimethylamino-phthalide,
3,3-bis(p-dimethylaminophenyl)-6-diethylaminophthalide,
3,3-bis(p-dimethylaminophenyl)-6-chloroaminophthalide,
6'-chloro-8'-methoxy-benzoindolino-pyrilospyran
6'-bromo-3'-methoxy-benzoindolino-pyrilospyran, etc.

As the color developer there may be used any of various acidic substances which, under heating, react with the leuco dye and cause the leuco dye to develop color. For example, phenolic substances, as well as organic or inorganic acid substances, are preferred. More concrete examples include: salicylic acid, 3-isopropylsalicylic acid, 3-cyclohexylsalicylic acid, 4,4'-isopropylidenediphenol (bisphenol A), 4,4'-isopropylidenebis(2-chlorophenol), 4,4'-isopropylidenebis(2,6-dibromophenol), 4,4'-isopropylidenebis(2-methylphenol), 4,4'-cyclohexylidenebisphenol, 4,4'-cyclohexylidenebis(2-methylphenol), 4-phenylphenol, 4-hydroxydiphenoxide, α-naphthol, β-naphthol, 3,5-xylenol, thymol, 4-hydroxyacetophenone, catechol, resorcinol, pyrogallol, phloroglycine, 2,2'-methylenebis(4-chlorophenol), 2,2'-dihydroxy-diphenyl, ethyl p-hydroxybenzoate, propyl p-hydroxybenzoate, butyl p-hydroxybenzoate, benzyl p-hydroxybenzoate, p-hydroxybenzoic acid-p-chlorobenzyl, p-hydroxybenzoic acid-p-methylbenzyl, benzoic acid, 1-hydroxy-2-haphthoic acid, 2-hydroxy-6-naphthoic acid, 4-hydroxydiphenylsulfone, bis(4-hydroxyphenyl)sulfide, 2-hydroxy-p-toluic acid, tartaric acid, oxalic acid, maleic acid, citric acid, succinic acid, boric acid, clay, and activated clay.

As to the proportions of the leuco dye and that of the color developer, the developer is used in an amount of 1 to 10, preferably 2 to 5, parts by weight based on 1 part by weight of the leuco dye.

A hot melt component may be used for enhancing the coloring sensitivity. A compound having a melting point of about 50° C. to 150° C. is preferred such as, for example, a fatty acid ester, a fatty acid amide, or wax. As more concrete examples are mentioned benzoic acid-4- benzyl ester, benzoic acid-4-methoxyphenyl ester, lauric acid amide, stearic acid amide, caproic acid amide, carnauba wax, montan wax, and polyethylene wax. The hot melt component just exemplified is used in an amount of 1 to 10, preferably 1 to 3, parts by weight based on 1 part by weight of the leuco dye.

The heat-sensitive coupler, or heat sensitizer, described above is applied to the whole surface of the color image forming sheet 1 having the color area 7 of plural colors in a predetermined pattern (color stripes C, M and Y of cyan, magenta and yellow in the embodiment being considered). When the sheet 1 is subjected to printing by means of a thermal printer such as a word processor for example, the thermal head of the thermal printer causes the heat sensitizer to develop color (blackening), resulting in that part of the color area 7 on the color image forming sheet is covered and hence a color image appears on the same sheet.

In this case, on the word processor side are provided a software for selecting which of the color stripes C, M and Y on the sheet 1 is to be covered and a registration index or sensor for registration of the sheet 1 and the thermal head.

As is the case with the foregoing photochromic agent, if the heat sensitizer is printed not over the whole surface of the color image forming sheet 1 but in accordance with an image pattern, a color image can be presented on the sheet 1 merely by the application of heat.

Further, if an image is printed on the color image forming sheet 1 in an image pattern using a transparent adhesive and a color powder (e.g. black toner) is sprinkled over the sheet, the powder is deposited on the transparent adhesive of the image pattern, whereby the image can be allowed to emerge clearly on the sheet.

Figures 14A, 14B, 14C, 14D, 14E, 14F:
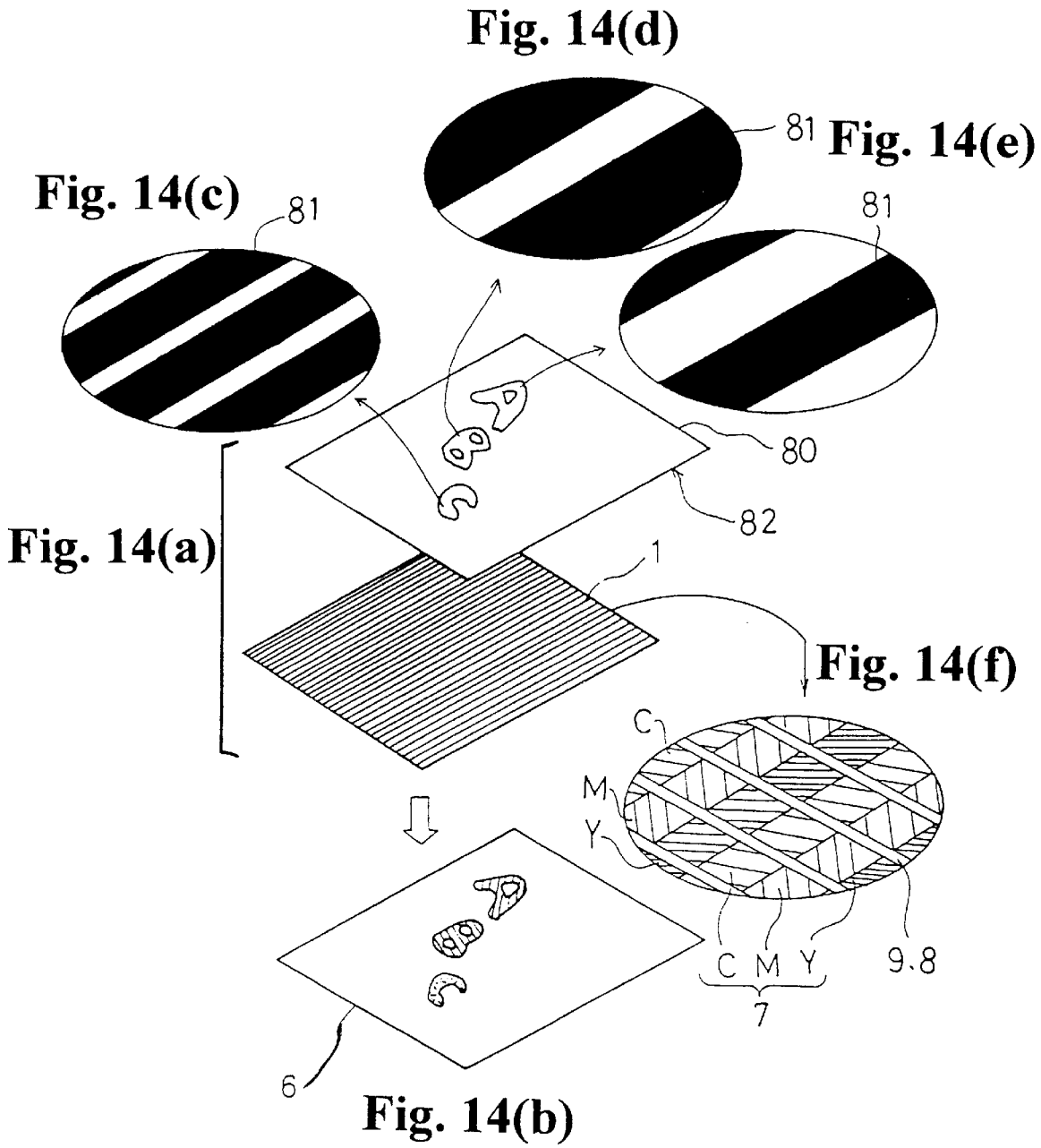
FIGS. 14 are a perspective view showing a cover sheet provided with black stripe-like covering means, also showing a color image forming sheet and further showing a color image object obtained by placing both sheets one upon the other and partially enlarged views of the cover sheet and the color image forming sheet.

Reference will now be made to an embodiment in which the color image forming sheet 1 shown in FIG. 1 and a cover sheet comprising a light transmitting sheet and black covering means printed thereon are superimposed together to form a desired color image. As shown in FIG. 14, on a light transmitting sheet 80 is formed a desired image (the letters "ABC" in the figure) using black stripes 81. The image is composed of black stripes 81 of different thicknesses. The light transmitting sheet 80 is placed on the color area 7 side of the color image forming sheet 1 described in connection with FIG. 1. The ground color of the sheet 1 is observed through the transparent portion of the sheet 1, while in the image portion of the sheet 80 there is observed a color image "ABC" by a color mixture of three primary colors not covered with the black stripes 81. An image may be formed on the light transmitting sheet 80 using black stripes 81 whose phase (width and pitch) substantially matches the color stripes C, M and Y on the color image forming sheet.

Even when color stripes C, M and Y of cyan, magenta and yellow are formed on the light transmitting sheet 80 using light transmitting inks, while black stripes are formed on a light non-transmitting sheet, then both are superimposed together and the resulting laminate is observed from the light transmitting sheet side, there is obtained the same effect as in the construction illustrated in FIG. 14.

In connection with the embodiment wherein the color image forming sheet 1 shown in FIG. 1 and a cover sheet 82 with black stripes 81 printed on the light transmitting sheet 80 are superimposed together to form a desired color image, there may be made a modification such that both superimposed sheets are not fixed completely but are relatively movable at least at a portion of the resulting color image object, for example only one opposed sides of both rectangular sheets are fixed together, thereby permitting movement of the cover sheet 82 relative to the color image forming sheet 1. According to this modification, even a very small relative movement between both sheets 1 and 82 causes a change in color of the color image. Therefore, it is possible to enjoy a variety of colors and changes thereof, and there can be attained an extremely significant aesthetic effect visually. Such a color image object is effective also as an advertising means.

According to the embodiments of the invention described hereinabove there is provided a color image forming sheet having a color area of plural colors arranged regularly on a substrate and a ground color area in which the ground color of the substrate is exposed, and a covering means is placed on at least part of the color area, allowing a desired color to be presented by a color mixture of colors not covered with the covering means. As is seen from the above embodiments, various colors may be adopted as constituent colors of the color area. Also as to the pattern constituted by those colors, no limitation is made to a stripe pattern. Various other patterns are adoptable. Further, as to the substrate on which the color area is to be formed, it can be selected from among substrates of various ground colors. Also as to the color of the color area covering means, any of various colors may be used. As means for applying the covering means onto the color area there also may be used various devices, implements, materials and methods as exemplified in the above embodiments.

In the color image forming sheet of the present invention, since a color area of a regular pattern is disposed on a substrate so that a ground color area of the ground color of the substrate is formed in a regular pattern, the brightness of the entire color image forming sheet is improved as compared with the case where the whole surface of the substrate is covered completely with a color area. In the color image forming sheet of the present invention, moreover, since the ground color exists while taking delicate balance in combination with a color mixture of colors in a regular color area, it is difficult to take a faithful color copy thereof even with use of a color copier. Copying gives rise to a great difference between the original and a copy obtained and thus there is attained a copy preventing effect. Further, since the color area is divided minutely, there occurs more, which makes it difficult to take a copy with a copying machine.

What is claimed is:

1. A color image forming sheet comprising:

a sheet substrate having an outer surface and a ground color, a color area formed on at least a part of the outer surface of the sheet substrate and having a plurality of elongated color portions arranged side by side in a uniform pattern, said elongated color portions constituting parallel color stripes of predetermined colors, a width of each stripe being between 0.05 and 0.22 mm, said color portions being different in color from said ground color so that when a part of the color portions is covered, colors of uncovered color portions and said part of the color portions which is covered are mixed visually to provide a color different from that of the color area where there is no covering, and a ground color area having said ground color, said ground color area being disposed in the color area in a uniform pattern to thereby improve a reflection density, said pattern of the ground color constituting exposed ground color stripes of the sheet substrate extending in one of first and second directions, said first direction extending perpendicular to a longitudinal direction of the color stripes and said second direction extending parallel to the longitudinal direction of the color stripes, a width of each ground color stripe being from 20 to 30% of the width of the color stripes.

2. A color image forming sheet according to claim 1, wherein said color stripes are arranged in a uniform order, and each of said ground color stripes is disposed parallel to and between two adjacent elongated color portions, respectively.

3. A color image forming sheet according to claim 2, wherein said color stripes arranged in the uniform order are repeated uniformly in the color area.

4. A color image forming sheet according to claim 1, wherein said ground color stripes extending in the first direction are spaced apart from each other at uniform intervals to divide the color stripes.

5. A color image forming sheet according to claim 4, wherein said color stripes arranged in the uniform order are repeated uniformly in the color area.

6. A color image forming sheet according to claim 1, wherein each of the elongated color portions includes a large number of dots spaced apart from each other.

7. A color image forming sheet according to claim 1, wherein each of the elongated color portions is covered with a specified color continuously.

8. A color image forming sheet according to claim 1, wherein said color stripes are formed of three primary colors.

* * * * *